United States Patent [19]

Jaeger et al.

[11] Patent Number: 4,878,392

[45] Date of Patent: Nov. 7, 1989

[54] GEAR DRIVE FOR SHUTTLELESS LOOMS

[75] Inventors: Siegfried Jaeger; Wilhelm Herrlein, both of Lindau/B, Fed. Rep. of Germany

[73] Assignee: Lindauer Dornier Gesellschaft m.b.H., Lindau/B, Fed. Rep. of Germany

[21] Appl. No.: 249,418

[22] Filed: Sep. 23, 1988

[30] Foreign Application Priority Data

Sep. 23, 1987 [DE] Fed. Rep. of Germany ..... 3731990
Aug. 1, 1988 [DE] Fed. Rep. of Germany ..... 3826156

[51] Int. Cl.[4] ..... F16H 5/06

[52] U.S. Cl. ..... 74/333; 74/423; 192/90; 192/94

[58] Field of Search ..... 74/333, 350, 416, 417, 74/423, 348; 192/67 R, 90, 94

[56] References Cited

U.S. PATENT DOCUMENTS 2,307,264 1/1943 Hamlin ..... 192/90 X
3,172,515 3/1965 Wrensch ..... 192/90
3,400,797 9/1968 Horn et al. ..... 192/90 X
3,520,205 7/1970 Halibrand ..... 74/417 X
4,188,833 2/1980 Krauss et al. ..... 74/417
4,773,518 9/1988 Road et al. ..... 192/90 X

FOREIGN PATENT DOCUMENTS 3620688 1/1987 Fed. Rep. of Germany .

*Primary Examiner*—Dwight G. Diehl
*Attorney, Agent, or Firm*—W. G. Fasse; D. H. Kane, Jr.

[57] ABSTRACT

A gear drive for a shuttleless loom is equipped with a coupling device or clutch between an input first gear group (G1) and an output second gear group (G2). The coupling or clutch provides a form-locking connection between the two gear groups which convert a continuous rotational movement on the input side into a back-and-forth movement on the output side to drive, for example, a gripper rod for the insertion of the weft thread into the loom shed. The coupling device or clutch can be rapidly operated by an electromagnet or by an electric motor and greatly facilitates performing the operations that are, for example, necessary for repairing a broken weft thread.

14 Claims, 4 Drawing Sheets

GEAR DRIVE FOR SHUTTLELESS LOOMS

FIELD OF THE INVENTION

The invention relates to a gear drive for shuttleless looms in which weft thread inserting devices, e.g. gripper rods, reciprocate into and out of the loom shed.

DESCRIPTION OF THE PRIOR ART

The drive means of shuttleless looms of this type have continuously rotating cam disks on the drive input side for reciprocating a toothed rack or the like through respective drive means. The toothed rack meshes with a pinion which in turn drives gear means on the power output side for the weft thread inserting devices, e.g. gripper rods or tapes. The drive means on the power output side include a drive element for the weft thread inserting devices and such drive element is driven back and forth in alternating opposite rotational directions. German Pat. Publication No. (DE-OS) 3,620,688 discloses a gear drive of this type which is capable of deriving rotational motions with alternating opposite roational directions from the shuttleless loom main drive shaft which rotates continuously in the same direction. The so derived alternating rotational directions of the drive element for the weft thread inserting devices is used to impart an alternating back and forth motion to the weft thread inserting devices.

In all instances in which weft thread inserting gripper rods are employed it is necessary to provide drive elements which alternatingly rotate in opposite directions. Such drive elements may be, for example, in the form of disks onto which a flexible belt is wound. Another possibility provides for drive wheels having a gear means meshing with perforated flexible belts or with toothed racks forming part of rigid gripper rods. The gear drives used in this connection, as illustrated by the above mentioned German Pat. Publication No. 3,620,688 (DE-OS) normally use two gear groups or sections. A first input gear drive section includes continuously rotating curve or cam disks which drive a piston type rod through cam follower rollers. The piston type rod in turn is operatively connected to a toothed rack member for moving the latter back and forth. A second output gear drive section includes a pinion that meshes with the toothed rack member of the input gear drive section for deriving the back and forth oscillating movement from the toothed rack member. The pinion in turn cooperates with further gear drive elements for obtaining the r.p.m. translation that is required for driving the drive element of the weft thread insertion. Such drive element for the weft thread insertion means may, for example, be a drive gear wheel meshing with the toothed rack portion of the gripper rod. In another embodiment such drive gear wheel may mesh with the perforations in a flexible belt for driving the weft thread inserting members.

Gear drives of the type described above must satisfy high reliability and precision requirements. Additionally, such gear drives must assure that the weft thread insertion stroke can be precisely adjusted without any elaborate procedures and without any involved control steps. A further important requirement in this context is the fact that one end position of the two end positions of a gripper or grippers must remain constant. In other words, a rotation of the gripper drive wheel must have no adverse feedback effects on the gear drive system.

Furthermore, the gear drive for such looms must satisfy the requirement that the loom can be caused quickly and without any problems to run in the reverse direction when thread breakage occurred to permit a quick repair of such thread breakage. During the return or reverse run of the loom the grippers must not move while all other components of the loom, such as the weaving reed, must move. In other words, a gear drive is required that makes it possible to switch off the gripper drive. The above mentioned German Pat. Publication No. 3,620,688 (DE-OS) does not disclose such a possibility.

OBJECTS OF THE INVENTION

In view of the foregoing it is the aim of the invention to achieve the following objects singly or in combination:

to provide a gear drive mechanism for looms as described above, which mechanisms will provide a substantially quicker and more certain coupling or decoupling possibility needed, for example, when a broken thread must be repaired;

to construct a gear of the type described which will be subject to minimal wear and tear and hence will be operating substantially maintenance free;

to avoid any elaborate adjustments and controls after the gripper stroke has been adjusted by a rotation of the gripper drive wheel; and to construct the drive mechanism in such a way that damages are certainly avoided, for example, damages that otherwise might be caused by improperly performed maintenance work.

SUMMARY OF THE INVENTION

The gear drive according to the invention is characterized by the following features. A form-locking coupling or clutch is arranged between the above mentioned pinion and an input drive gear wheel arranged coaxially to the pinion. The coupling or clutch is arranged in such a manner that the pinion in the form of a pinion sleeve is rotatably supported on an output shaft of a power transmitting output gear drive section. The pinion sleeve is axially displaceable but remains meshing with a toothed rack sector of the input gear drive section. The pinion sleeve has at one of its ends crown gear type teeth for meshing in a form-locking manner with inner gearing coupling means. These inner gearing coupling means are arranged in a disk type gear member mounted on said output shaft for rotation with the shaft. The pinion sleeve is further connected in a form-locking manner with an armature of a drive member or element. The armature is fixed against rotation in a housing in which it is axially displaceable in parallel or rather coaxially to said output shaft. The output shaft can be clamped into a fixed non-rotatable position by means of a ring clamping spring arranged on the armature, whereby the ring clamping spring is effective when the armature is in its decoupled end position independently of any instantaneous angular position of the output shaft.

An essential difference between the invention and the prior art provides the advantage that according to the invention, a very rapid coupling is achieved during the decoupling, as well as during the recoupling. Due to the construction which provides for short strokes of the drive elements of the coupling, the present structure achieves exactly defined positions for the movable components of the coupling or clutch. In this connection it is a further advantage that the shaft which transmits the drive power to the drive element of the weft thread insertion member can be arrested into a non-rotatable position independently of its instantaneous angular position, whereby the arresting takes place in a force-locking manner so that any undesired displacement, for example, due to tampering with the drive element, is definitely avoided. On the other hand, when the loom runs in the reverse direction, the same features also prevent with certainty any uncontrolled motion of the weft thread insertion members, for example, of the gripper rods, into the loom shed. As mentioned, the arresting of the shaft is accomplished advantageously be means of a ring clamping spring element.

The motion of the armature is easily controlled by limit switches in both end positions of the armature. The control is simple because the armature performs a linear movement and because the strokes of the movable armature are exactly adjustable, for example,by means of interposed adjustment disks. These limit switches produce in both end positions of the armature, that is when the pinion is coupled to the drive train and when the pinion is decoupled from the drive train, a respective switching signal for respectively influencing the operational state of the loom. This feature has the advantage that anytime when the pinion does not have a defined position, that is, when there is no trouble-free coupling state, any drive of the loom is prevented. Stated differently, neither a return run nor a new start is possible in this situation, whereby any danger of accidents is substantially reduced. The decoupling can be performed electromagnetically or by an electric motor. The recoupling can be performed, for example, in a simple manner by a reset spring which becomes effective after the electromagnet has been switched off. In the embodiment employing an electric motor the coupling takes place with the motor drive without a reset spring. Thus, an exact recoupling of the structural components of the drive trains is achieved by a stop of the movable armature against an adjustment disk or disks which are insertable in the gear housing in an exchangeable manner for adjusting the stroke of the armature.

Where an electromagnet is used for the decoupling, it is advantageous that the electromagnet can be constructed of a few simple components thereby avoiding many movable interacting individual elements so that the magnet can be of compact construction. The magnet is enclosed by a simple protective housing, thereby preventing contaminations of the magnet by dust or lint. During the weaving the entire coupling system does not require any power input, yet it is always in a safely engaged coupling state during weaving. The position and the stroke of the magnetically cooperating elements can be adjusted by exchangeably insertable disks so dimensioned that exact adjustments are possible.

In the decoupled state the coupling components cannot change their angular position because any torque moment that might be introduced through the gripper drive element such as a gear wheel, is introduced into the gear housing by the non-rotatable guide of the armature. Thus, the reset spring means press the axially displaceable coupling member into a perfectly meshing position. As mentioned, the pinion is constructed as a sleeve which is axially slidable on the output shaft. The teeth of the pinion have a sufficient length such that the pinion remains in a meshing engagement with the toothed rack sector even if the pinion sleeve is axially displaced for the decoupling. Near the end of the sleeve the teeth of the sleeve pinion are lengthened so that they can function as a coupling element in the manner of a crown gear rim for engaging a respective inner gearing of a disk type component to form a claw coupling. The disk type component is operatively connected to the gripper drive element by a respective gear train.

Rather than driving the coupling or clutch by means of an electromagnet, it is also possible to derive the drive from a d.c. gear drive motor driving a control spindle by means of a gear teeth segment. The control spindle is arranged coaxially to the shaft and converts the rotation of the gear segment into a longitudinal displacement for axially moving the pinion sleeve by means of the armature driven by the motor.

Any excess stroke of the coupling is adjusted by means of rotating an adjustment sleeve. Once the adjustment is completed a threaded pin arrests the adjusted sleeve in a fixed position so that the sleeve is only axially movable but cannot rotate. Thus, a simple adjustment of the clutch is accomplished without using spacer disks which are needed when the drive element is an electromagnet.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
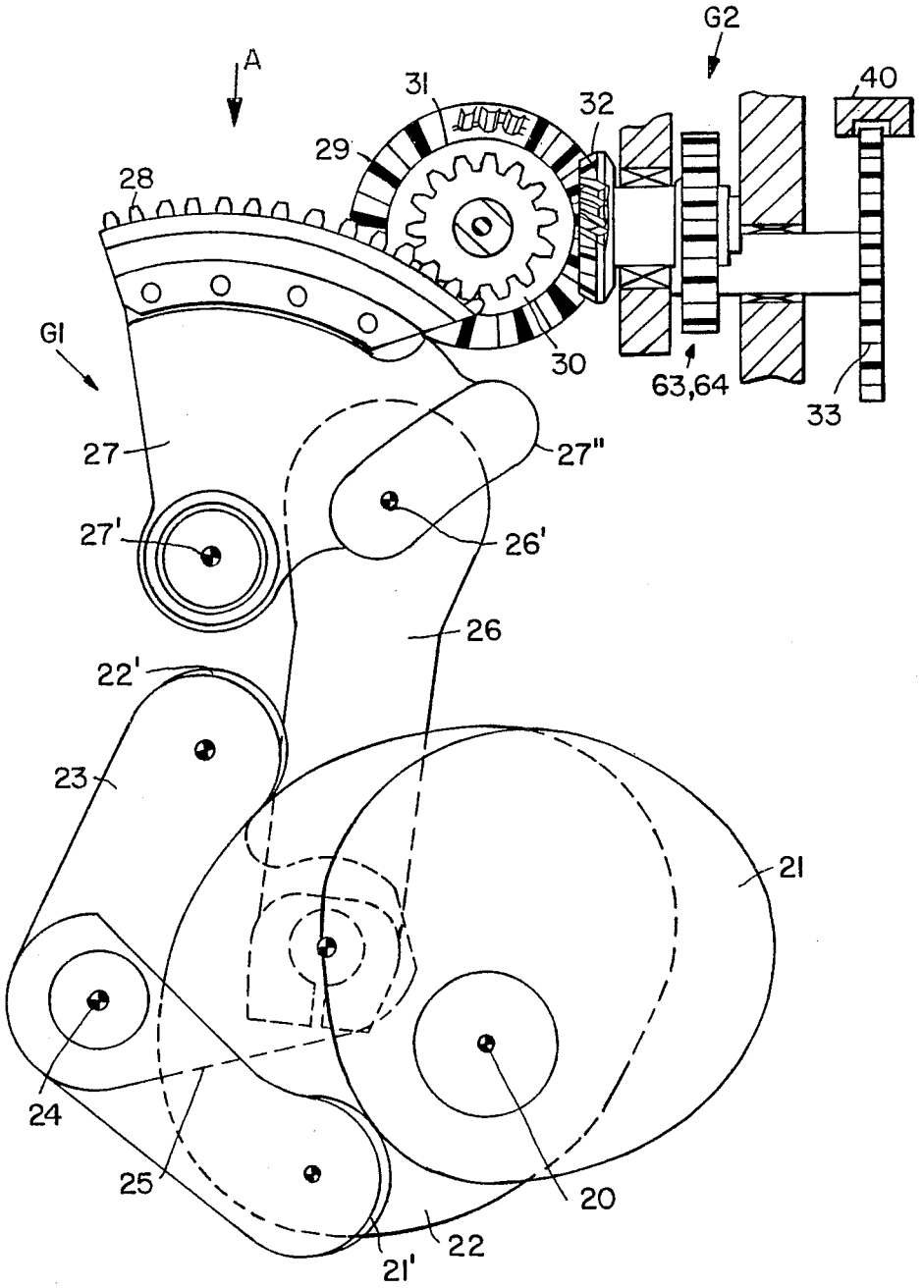
FIG. 1 is a schematic illustration, partially in section, of a drive mechanism for the weft thread insertion means in shuttleless looms using the present coupling.

Referring first to FIG. 1, the overall construction of the gear drive will be briefly described. The gear drive translates a continuous rotational movement of the machine main shaft 20 into a rotational movement that alternates in opposing rotational directions for driving the drive element, for example, a drive gear wheel 33 for the weft thread insertion member 40 in a shuttleless loom. The construction of the gear drive as such shown in FIG. 1 is known and includes a first partial gear section G1 on the drive input side and a second partial gear drive section G2 on the power output side. Cam disks 21, 22 are arranged on the continuously rotating main drive shaft 20. Cam follower or sensor rollers 21' and 22' contact the circumference of the cam disks 21 and 22 respectively. Each cam follower roller 21', 22' is rotatably supported at the respective end of a bell crank or angle lever 23. The angle lever 23 itself is journalled on a journal bearing shaft 24 permitting a back and forth oscillating movement of the bell crank 23. The journal bearing shaft 24 is rigidly secured to the machine frame not shown. A lever arm 25 connects the bell crank 23 to a piston rod type member 26, whereby the oscillating movement of the bell crank lever 23 is transmitted through the rod 26 of a toothed rack sector 27. The toothed rack sector 27 is rotatably supported in the machine frame by a bearing 27'. A journal 26' connects the piston rod type member 26 to the toothed rack sector 27. The journal 26' is adjustable in its position along an elongated arcuate guide hole 27'' in the toothed rack sector 27. This adjustment of the position of the journal 26' along the guide hole 27'' permits changing the stroke of the toothed rack sector 27 and thus also of the stroke on the power output side, whereby the stroke, for example, of a weft thread inserting member such as a gripper rod 40, is adjustable. The toothed r sector 27 is provided with a gear teeth section 28 having the shape of a circular arc sector. This gear teeth section 28 forms the output member of the first drive gear group G1 in which the continuous rotational movement of the main loom drive shaft 20 is converted into a back and forth oscillating movement about the journal bearing 27' of the toothed rack sector 27.

The back and forth oscillating movement as just described is converted by the driven output gear group G2, into a rotational motion of the drive gear wheel 33 which rotates alternatingly in opposite rotational directions. For this purpose, the second ear group G2 comprises a pinion 29 meshing with the gear teeth section 28 of the toothed rack sector 27 and a gear element 31 mounted on a common shaft 30 with the pinion 29. The gear element 31 is a disk type input bevel gear wheel 31 forming part of an angular gear drive comprising a further bevel gear 32 forming a bevel gear drive. Additional gear drive wheels 63, 64 assure a transmission with the required translation and drive of a drive element such as the drive gear wheel 33 for the weft thread inserting member 40.

Figure 2:
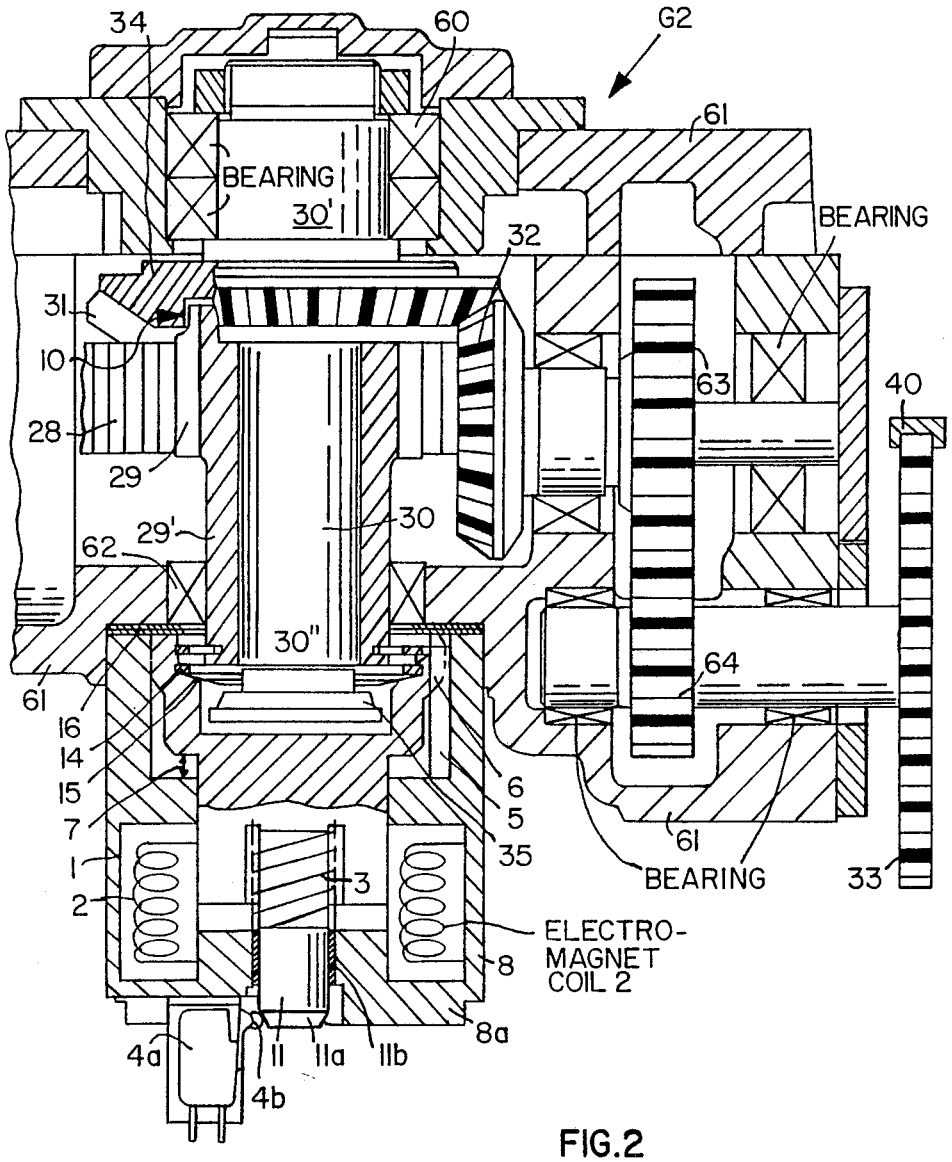
FIG. 2 illustrates a sectional view through a coupling device according to the invention for use in the gear drive of FIG. 1, whereby the coupling device is shown in the force transmitting, coupled state maintained by a spring.

FIG. 2 shows, mainly in section, a view in the direction of the arrow A in FIG. 1. The gear members of the second gear group G2 are shown in somewhat more detail in FIG. 2 than in FIG. 1. The gear teeth section 28, which is a member of the first gear group G1, is shown only partially in FIG. 2. The toothed sector 27 is not visible below the pinion 29.

The arrangement and cooperation of the essential components of the invention will now be described in more detail. The pinion 29 meshing with the gear teeth section 28 is constructed according to the invention as a pinion sleeve 29' which is rotatably supported on the above mentioned shaft 30 forming part of the second gear group G2. A disk type structural member simply referred to as disk 34, is rigidly secured to the shaft 30. The disk 34 carries the bevel gear wheel 31 forming the input gear wheel of the second gear group G2. The bevel gear wheel 31 meshes with a further bevel gear 32. The upper end 30' of the shaft 30 is conventionally mounted in bearing means 60 which in turn are mounted in the housing 61 for both gear groups Gl and G2. The lower end 30'' of the shaft 30 is rotatably supported inside the sleeve 29' which in turn is supported by a bearing 62 in the housing 61. The bevel gear 32 drives through further gear wheels 63 and 64 conventionally mounted in the housing 61, the output gear wheel 33 for driving, for example, a gripper rod 40 which is movable perpendicularly to the plane of the drawing. The gripper rod has a conventional toothed rack which meshes with the drive wheel 33. For simplicity's sake a rigid gripper rod 40 is shown. However, the gripper rod could be replaced by a gripper carrying belt or the like.

Figure 3:
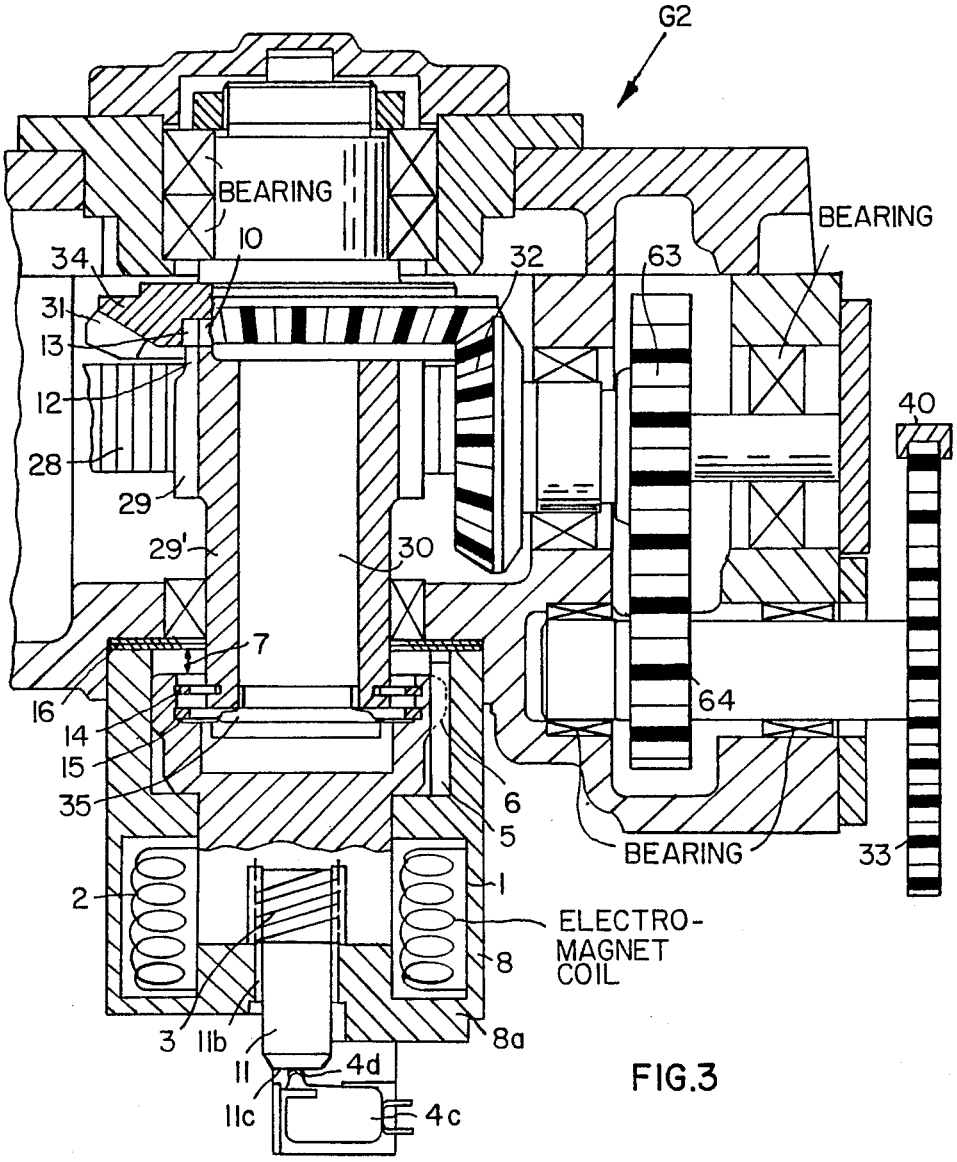
FIG. 3 is a sectional view corresponding to that of FIG. 2, but showing the coupling device in the decoupled state maintained by an electromagnet.

A coupling or clutch 10 is arranged according to the invention between the pinion 29 of the sleeve 29' and the disk 34. As seen in FIG. 3, the clutch or coupling 10 comprises a crown gear 12 forming a ring gear around the axially facing end of the pinion 29. The coupling further comprises a respective inner gearing 13 in the disk 34. The crown gear 12 and the inner gearing 13 mesh with each other when the coupling is in the engaged state as shown in FIG. 2. The crown gear 12 is disengaged from the inner gearing 13 when the clutch is in the decoupled state as shown in FIG. 3. Thus, the two gear components 12 and 13 form a type of claw coupling. When the claw coupling is engaged and the pinion 29 is driven in opposing rotational directions by the back and forth movement of the gear teeth section 28, the disk 34 is respectively driven. Accordingly, the angular gear with its bevel gear wheel 31 and 32 drives the drive wheel 33 in alternatingly opposing rotational directions.

Referring further to FIGS. 2 and 3, an electromagnet 2 is provided for disengaging the clutch. The magnet 2 comprises a coil winding mounted in a housing 8 which in turn is secured to the machine housing or frame 61. The electromagnet 2 further comprises an armature 1 mounted coaxially to the shaft 30. The armature 1 is axially displaceable by the action of the magnetic coil 2. The lower end of the armature 1 has a projection 11 of reduced diameter which passes through a guide bore llb in a cover 8a of the housing 8. A reset spring 3 surrounds the projection 11. One end of the reset spring 3 bears against the inner surface of the cover **8*a*. The other end of the spring 3 bears against the armature 1. The reset spring 3 normally biases the armature 1 axially upwardly to cause the engaged state of the clutch as shown in FIG. 2. However, when the electromagnet 2 is energized, the armature will move axially downwardly against the force of the spring 3 as shown in FIG. 3, thereby compressing the spring 3**.

Spacer disks 16 each having an exact thickness may be inserted between the housing 8 and the main gear housing 61. The spacer disk 16 is exchangeable with similar disks of different dimensions for adjusting the stroke of the armature 1 and the excess stroke of the clutch 10. When the clutch is engaged as shown in FIG. 2, the armature 1 is urged by the reset spring 3 against the respective spacer disk 16, whereby the spacing 7 corresponds to the stroke of the armature 1. The armature 1 is guided in its axial movement by a guide tongue 5 engaging a groove 6 in an end portion of the armature 1. The tongue 5 is rigidly secured to the housing 8. Thus, the armature 1 can move axially, but it cannot rotate about the longitudinal axis of the shaft 30. As mentioned, when the electromagnet 2 is not energized, the spring 3 tends to keep the clutch in its engaged condition. In this condition a limit switch **4*a* contacts, for example, with its sensor member 4*b* a beveled end portion 11*a* of the projection 11 of the armature 1. Thus, the limit switch 4*a* provides a respective signal representing the position of the armature 1 and thus can influence the operation of the loom, for example, permit the energizing of the main loom drive. Even a very small displacement of the beveled portion 11*a* relative to the sensor 4*b* changes the signal from the limit switch 4*a*, whereby an incomplete engagement of the coupling is recognized and the resulting difference signal of the end switch 4*a* stops the main drive of the loom. The position shown in FIG. 2 signifies a complete engagement of the clutch components 12 and 13**, whereby the main loom drive can be energized.

FIG. 3 shows a further limit switch 4c having a sensor 4d engaging an end face 11c of the projection 11 of the armature 1 to sense the energized state of the electromagnet 2 in which the armature 1 is pulled into the electromagnet to the lowermost position of the armature 1. In this position the armature does not contact the spacer disk 16. At least one clip ring 14 rigidly secures the armature 1 in a form-locking manner with the pinion sleeve 29'. The clip ring or rings 14 are so constructed that the pinion sleeve 29' remains rotational relative to the shaft 30, and additionally, can be axially moved relative to the shaft 30. By axially displacing the pinion sleeve 29' downwardly, the gear teeth members 12 and 13 of the clutch 10 are disengaged from each other so that the second gear group 2 is decoupled from the first gear group 1.

The clip ring or rings 14 are inserted in an inner groove of a cup-shaped end of the armature 1 and engage a radially outer groove at the lower end of the sleeve 29'. Thus, these rings 14 surround the lower end of the sleeve 29'. Additionally, the cup-shaped end of the armature 1 carries a ring type tensioning spring 15, for example, a Belleville type spring which comes to bear at the end of the armature stroke against a conical ring projection or end collar 35 at the lower end of the shaft 30. As a result of this contact, the Belleville type ring tension spring 15 is so deformed, that its inner diameter becomes smaller so that it rigidly encircles the radially outwardly facing conical surface of the end collar 35 of the shaft 30, whereby the shaft 30 is rigidly engaged with the armature 1 in a force transmitting manner. As a result, and due to the above mentioned engagement of the guide tongue 5 in the groove 6 there is now a force transmitting connection between the armature 1 and the shaft 30 which prevents a rotation of both of these components when the components are in the position shown in FIG. 3. In FIG. 2 only the armature 1 is prevented from rotation while the shaft 30 can rotate. In the position shown in FIG. 3 any torque moment that may be introduced through the gear wheel 33 and passed on through the gear 63, 64, 32, 31 and through the disk 34 into the shaft 30, is introduced into the housing 8 through the guide tongue 5 and groove 6 so that any motion of the gripper 40 and of the second gear group 2 is properly arrested or blocked.

In the decoupled state shown in FIG. 3, the projection 11 of the armature 1 projects out of the cover 8a, thereby operating the limit switch 4c. Switch 4c produces a signal that may be used for controlling the weaving operation, for example to initiate special functions of the loom that are necessary for a reverse motion of the loom to repair a broken weft thread.

During the decoupled state, the teeth of the pinion 29 remain engaged with the teeth 28 of the back and forth oscillating toothed sector 27. In this manner the back and forth motion of the toothed sector 27 can be effective on the pinion 29. However, the back and forth oscillation of the sleeve 29' has no effects because the pinion 29 is rotatable relative to the shaft 30 and also rotatable relative to the armature 1. Since the clutch 10 is decoupled or disengaged, it becomes possible in this condition to work on the first gear group G1, for example, to perform a reverse motion of the loom without any adverse influence on the gear group G1 or on the gripper 40. In a corresponding manner the above mentioned special functions of the loom may be performed without any adverse feedback effect on the weft thread insertion members.

The coupling device according to the invention functions in such a way that when trouble occurs, for example, a weft thread has been broken, requiring a reverse motion of the loom, the electromagnet 2 is energized either manually by closing a switch or automatically in response to a weft thread breakage signal. A d.c. voltage is available for this purpose. However, the voltage source itself is not shown. The energized electromagnet 2 quickly pulls the armature 1 and hence the pinion 29 away from the disk 34 as shown in FIG. 3. For a coupling stroke of slightly less than 8 mm, an actual decoupling time has become shorter by order of magnitude as compared to the decoupling of known clutches. The decoupling times achieved according to the invention are within the range of fractions of a second. Once the decoupling is accomplished, the electromagnet 2 may be kept energized to hold the armature 1 in the position of FIG. 3 by a reduced energizing voltage. Once the repair is accomplished the electromagnet 2 is deenergized and the armature as well as the pinion 29 with its sleeve 29' are returned into the coupled position of FIG. 2 by the reset spring 3 which is supported in this action by the force of the ring or belleville type spring 15 at the beginning of the return stroke out of the decoupled position. The force of spring 3 is so determined that the armature 1 is brought into contact with the adjustment disks or disk 16 with certainty to thereby assure a proper coupled condition of the coupling elements 12 and 13.

Figure 4:
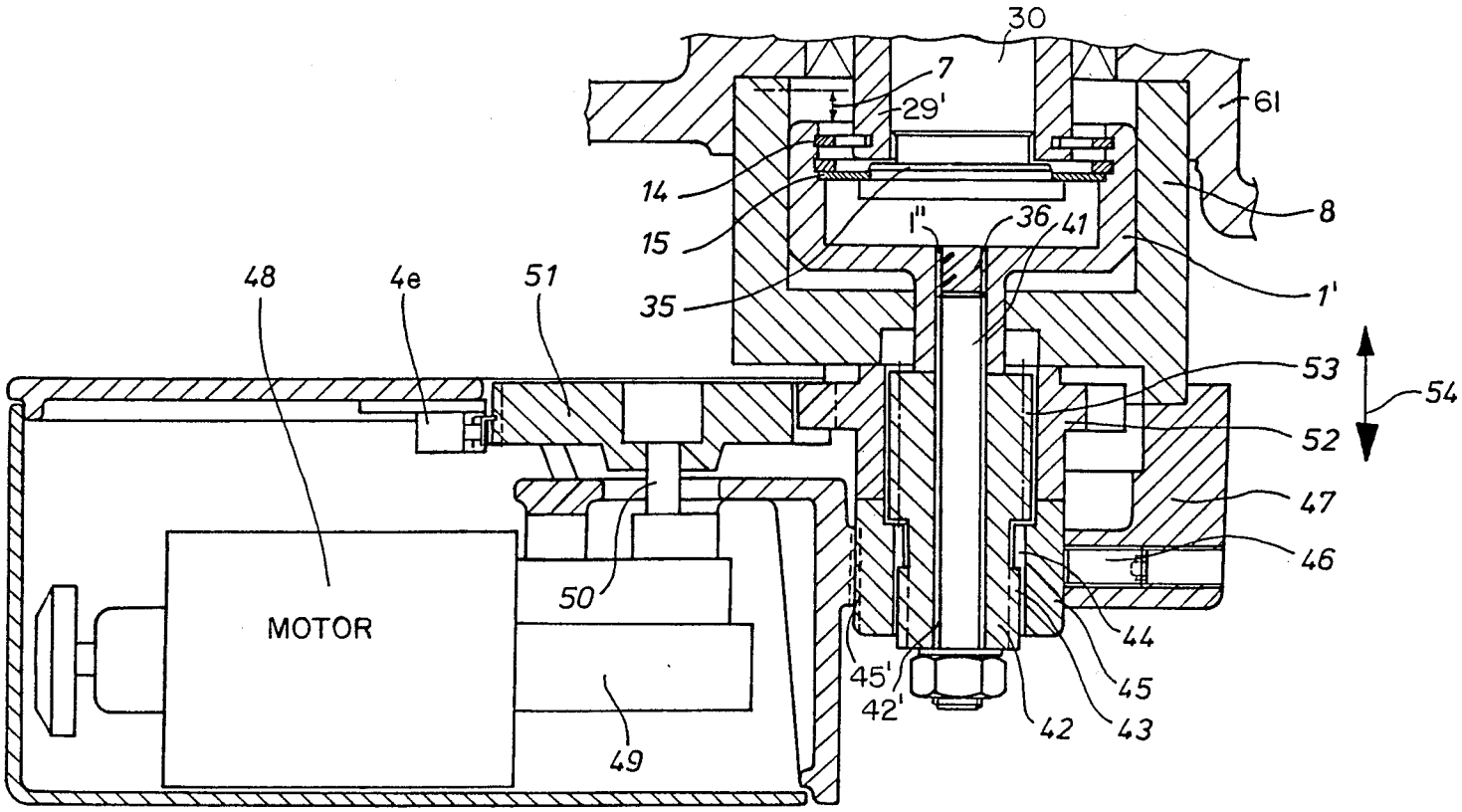
FIG. 4 shows a modified embodiment of a coupling device, according to the invention, using an electric motor as the drive element for displacing a pinion sleeve of the coupling device.

FIG. 4 illustrates another embodiment of the invention wherein only the lower portion of the clutch 10 is illustrated. All components not shown in FIG. 4 are identical to the respective components in FIGS. 2 and 3.

FIG. 4 shows the arrangement of an electromoter 48 for driving the clutch 10. Only one limit 4e is shown in FIG. 4 for simplicity's sake. The armature 1' of FIG. 4 has a longitudinal, at least partially threaded bore 1'' in which the threaded end 36 of a screw bolt 41 is received. The embodiment of FIG. 4 does not have a reset spring. The screw bolt 41 secures a control spindle 42 to the armature 1'. Thus, the control spindle 42 rotates with the armature.

The control spindle 42 is provided at its lower end with guide tongues 43 which engage into guide grooves 44 of a sleeve 45. The sleeve 45 is rigidly secured to a housing portion 47 which in turn is rigidly secured to the armature housing 8 which in turn is rigidly secured to the gear housing 61. The control spindle 42 has a longitudinal axial bore 42' which is axially aligned with the bore 1'' so that the threaded screw bolt 41 can pass through both bores 1'' and 42'.

The above mentioned electric motor 48 drives a power output shaft 50 through a reduction gear 49 to drive a gear wheel 51 rigidly secured to the output shaft 50. The gear wheel 51 meshes with a toothed segment 52 having an inner spindle type threading 53 which is axially effective for meshing with a respective outer spindle type threading of the control spindle 42. Thus, the control spindle 42 is driven by the motor 48, whereby the rotational movement of the gear wheel 51 is converted into an axial movement of the control spindle 42 by means of the spindle threading or teeth 53. As a result, the armature 1' is also displaced in the direction of the arrow 54 depending on the direction of rotation of the motor 48. This displacement causes the required stroke 7 of the pinion sleeve 29. This displacement of the pinion sleeve 29' in the axial direction is due to the connection between the spindle sleeve 29' and the armature 1' by the clip ring 14. Accordingly, the same coupling and decoupling between the gear elements 12 and 13 is achieved as described above with reference to FIGS. 2 and 3.

The embodiment of FIG. 4 with its electromotor 48 for driving the coupling means operates as follows. In addition to the above mentioned conversion of the rotational movement of the gear wheel 51 into an axial movement by the control spindle 42 and thus by the armature 1', the excess stroke of the coupling or clutch 10 is achieved by a rotation of the bushing 45. Once the bushing 45 has been rotated into the proper position, a set screw 46 is tightened. Prior to any further adjustment, the set screw is loosened again. When a further adjustment has been made, the adjustment bushing 45 is again locked in place by tightening the set screw 46. The just described adjustment by means of the sleeve 45 is facilitated by an outer threading 45. The sleeve or bushing 45 functions in the same way as the above described adjustment by means of the spacer disk. The limit switch **4*e* is so positioned that it senses the coupled state of the clutch 10 when the switch is operated by the gear wheel 51 which in practice may be a toothed segment. The limit switch 4*e* provides a controlled signal for applying a counter current or counter torque brake action to the motor 48 so that at all times the exact same position is enforced for the pinion sleeve 29'**.

The disengaged or decoupled state of the clutch is sensed by a further limit switch not shown, but positioned similarly to the limit switch **4*c* in FIG. 3**.

Although the invention has been described with reference to specific example embodiments, it will be appreciated, that it is intended to cover all modifications and equivalents within the scope of the appended claims.

What we claim is:

1. A gear drive for driving a weft thread insertion member in a shuttleless loom, comprising housing means for supporting said gear drive, a first group of drive means forming a driving gear set, and a second group of drive means forming a driven gear set, shaft means (30) mounted for rotation in said housing means, said first group of drive means including a pinion sleeve (29') and a driving pinion (29) rigidly secured to said pinion sleeve (29'), said pinion sleeve being mounted for rotation on and relative to said shaft means (30) and for axial displacement relative to said shaft means (30), said second group of drive means comprising a driven gear (31) rigidly secured to said shaft means (30) for rotation with said shaft means, coupling means (10) operatively interposed between said driving pinion (29) and said driven gear (31) for transmitting a driving force from said driving pinion (29) to said driven gear (31), said coupling means comprising a first coupling member (12) at an axially facing end of said pinion sleeve (29') and a second coupling member (13) rigidly secured to said driven gear (31) for cooperation with said first coupling member (12) when said pinion sleeve (29') is in a coupling means engaging position, drive means for operating said coupling means, said drive means including an armature, means for securing said armature against rotation in said housing means while permitting an axial displacement of said armature in the direction of a rotational axis of said shaft means (30), means (14) connecting said armature to said pinion sleeve (29') in a form-locking manner for axially displacing said pinion sleeve (29') while permitting rotation of said pinion sleeve relative to said armature, and cooperating clamping means (15, 35) for rigidly attaching said shaft means (30) to said armature (1) in any rotational or angular position of said shaft means (30) when said pinion sleeve (29') is moved into a coupling means disengaging position by said armature and for detaching said shaft means from said armature when said pinion sleeve is moved into a coupling means engaging position by said armature, whereby said shaft means cannot rotate when said coupling means are disengaged and can rotate when said coupling means are engaged.

2. The gear drive of claim 1, wherein said driving pinion (29) has a length in an axial direction of said shaft means (30) sufficient for maintaining a meshing engagement between said driving pinion (29) and another element of said first group of drive means at all times.

3. The gear drive of claim 1, wherein said drive means for operating said coupling means comprise an electromagnet for driving said armature axially relative to said shaft means, and reset spring means (3) for axially urging said coupling means into engagement when said electromagnet is deenergized.

4. The gear drive of claim 1, wherein said drive means for operating said coupling means comprise an electromotor for driving said armature axially relative to said shaft means.

5. The gear drive of claim 1, further comprising signal generating means arranged for sensing both end positions of said armature to provide a first control when said armature is in a coupling means engaging position, said first control permitting a weaving operation, and to provide a second control when said armature is in a coupling means disengaging position, said second control permitting special functions of said shuttleless loom.

6. The gear drive of claim 5, wherein said signal generating sensing means comprise limit switches for sensing both end positions of said armature.

7. The gear drive of claim 1, wherein said clamping means for rigidly attaching said shaft means (30) to said armature (1) comprise a ring clamping spring (15) rigidly secured to said armature in such a position that said clamping spring (15) grips an end collar (35) of said shaft means when said armature (1) is in a coupling means disengaging position in which a lower end of said pinion sleeve (29') pushes said clamping spring against said end collar of said shaft means, and for disengaging said clamping spring from said end collar when said lower end of said pinion sleeve (29') is spaced away from said clamping spring in the coupling means engaging position of said armature and of said pinion sleeve.

8. The gear drive of claim 1, wherein said means for securing said armature against rotation in said housing means comprise tongue and groove guide means (5, 6) which prevent rotation of said armature but permit an axial displacement of said armature in said housing means.

9. The gear drive of claim 1, further comprising means for adjusting a stroke of said armature.

10. The gear drive of claim 9, wherein said stroke adjusting means comprise insert disks having a defined thickness and exchangeably insertable into said housing means for changing said stroke of said armature.

11. The gear drive of claim 9, wherein said stroke adjusting means comprise an insert sleeve (45) carrying on its inner surface at least part of said means for securing said armature against rotation while permitting an axial movement of said armature, an opening in said housing means in which said insert sleeve is adjustably received, and arresting means (46) for locking said insert sleeve in an adjusted fixed position relative to said housing means.

12. The gear drive of claim 11, wherein said insert sleeve has an external threading, wherein said opening in said housing means has an internal threading cooperating with said external threading for adjusting the position of said insert sleeve in said opening, said arresting means comprising a set-screw threaded through said housing means for locking said insert sleeve in said adjusted fixed position.

13. The gear drive of claim 1, wherein said first coupling member (12) of said coupling means comprise a crown type ring gear (12) at an axial end of said pinion sleeve (29') facing said driven gear (31), and wherein said second coupling member (13) of said coupling means comprises a gearing (13) positioned on said driven gear (31) for meshing with said crown type ring gear (12) when said pinion sleeve is in a coupling means engaging position.

14. The gear drive of claim 13, wherein said crown type ring gear forms an axial extension of said pinion sleeve, and wherein said driven gear (31) has a recess facing said crown type ring gear, said gearing (13) forming an inner gear ring in said recess.

* * * * *